United States Patent [19]

Ebihara

[11] Patent Number: 5,033,378

[45] Date of Patent: Jul. 23, 1991

[54] DEFECTIVE PRINT DETECTING DEVICE

[75] Inventor: Hiromitsu Ebihara, Toride, Japan

[73] Assignee: Komori Corporation, Tokyo, Japan

[21] Appl. No.: 471,046

[22] Filed: Jan. 26, 1990

Related U.S. Application Data

[63] Continuation of Ser. No. 141,103, Jan. 5, 1988, abandoned.

[51] Int. Cl.[5] ..... B41F 9/02; B41F 9/04

[52] U.S. Cl. ..... 101/152; 101/DIG. 45

[58] Field of Search ..... 101/181, 152, 153, 350, 101/365, 155–157, 170, DIG. 45; 382/1, 34, 45; 356/444, 229, 388, 390; 250/559; 358/285

[56] References Cited

U.S. PATENT DOCUMENTS 4,553,478 11/1985 Greiner et al. ..... 101/181
4,677,680 6/1987 Harima ..... 382/1

FOREIGN PATENT DOCUMENTS 61-12342 1/1986 Japan ..... 101/181

*Primary Examiner*—J. Reed Fisher
*Attorney, Agent, or Firm*—Rosen, Dainow & Jacobs

[57] ABSTRACT

A defect print detecting device having photographing means for photographing as an image the surface of a printing plate having a pattern to print and mounted on a plate cylinder, which compares reference image data acquired at the beginning of printing using the photographing means with checking image data acquired during printing, thereby determining the quality of the printed matter.

2 Claims, 3 Drawing Sheets

DEFECTIVE PRINT DETECTING DEVICE

This application is a continuation of application Ser. No. 141,103 filed 1/5/88, now abandoned.

DETAILED DESCRIPTION OF THE INVENTION

1. Field of the Invention

This invention relates to a defective print detecting device for checking the quality of a printed matter at the plate cylinder side, which can be advantageously used especially in an intaglio printing apparatus.

2. Background of the Invention

FIG. 3 is a diagrammatic view showing schematically a prior art intaglio printing apparatus. Referring to FIG. 3, paper sheets 3 to be printed are stacked on a pile board 2 of a sheet feeder 1, and extracted sheet by sheet to be fed onto a transporting belt 4. A swing device 5 being swung by a cam mechanism has a gripping claw which grips paper 3 transported on the transporting belt 4 down to its downstream end and carries the paper 3 to the extent of its swing angle. The paper 3 is fed to an impression cylinder 6 through a paper transfer cylinder 7. Thus, there are provided gripping claws 8 and 9 at positions dividing the outer peripheral surface of the impression cylinder 6 into three sections and a position on the outer peripheral surface of the paper transfer cylinder 7, respectively, which are opposing each other sequentially as the impression cylinder 6 and the paper transfer cylinder 7 rotate. The paper 3 gripped on the swing device 5 is transferred to the gripping claw 8 through the gripping claw 9 and wound around the peripheral surface of the impression cylinder 6.

A sprocket 10 is disposed near the paper transfer cylinder 7 on the opposite side of the impression cylinder 6. A delivery chain 13 is hooked up between the sprocket 10 and a sprocket 12 which is disposed in the vicinity of a pile board 15. The delivery chain 13 has a plurality (four in the figure) of gripper devices 14 at constant intervals, and the paper 3 intaglio printed between the impression cylinder 6 and an intaglio cylinder 16 is transferred from the gripping claws 8 to the gripper devices 14 and transported. The pile board 15 is located beneath the downstream end of the delivery chain 13, and receives and stacks the paper 3 which, after being transported to the downstream end, is released and dropped from the gripper devices 14.

The intaglio cylinder 16, which has the same diameter as the impression cylinder 6, has a plurality (three in the figure) of intaglio printing plates 17, and each of the intaglio printing plates 17 is provided with recessed lines as a pattern to print.

The surfaces of the intaglio printing plates 17 on the intaglio cylinder 16 are contacted against the peripheral surfaces of a plurality (three in the figure for printing three colors) of pattern rollers 18 having a diameter of about one-third that of the intaglio cylinder 16. On the peripheral surfaces of the pattern rollers 18 are formed reliefs (not shown) corresponding to individual patterns of individual colors, through which the intaglio printing plates 17 are supplied with inks of individual colors in ink fountains 22 through fountain rollers 19. In this case, the reliefs are formed larger than the corresponding recessed pattern lines of the intaglio printing plates 17, and parts other than the reliefs are relatively recessed so as not to contact with the intaglio printing plates 17.

There is provided a wiping roller 26 rotating in the same direction as the intaglio cylinder 16 and contacting against the intaglio cylinder 16 at a position obliquely beneath the intaglio cylinder 16, that is, at the downstream side of the pattern rollers 18 with respect to the rotational direction of the intaglio cylinder 16. The wiping roller 26 wipes off excessive inks on the surfaces of the intaglio printing plates 17. A wiping tank 28 having a plurality of brushes 29 and filled with a cleaning solution 27 is disposed beneath the wiping roller 26. The cleaning solution 27 accumulated on the wiping roller 26 is scraped off by a doctor blade 30.

During printing operation using the above-described intaglio printing apparatus, there may occur a defective print due to dust or the like stuck onto non-pattern line areas. For this reason, up until now, the printed matter have been checked sheet by sheet by an operator.

In order to reduce the need for such checking, a system has been developed in which the image of a printed matter to be a reference is acquired using image processing means having an optical camera system and compared with image data of a printed matter to be checked acquired using the same image processing means to detect a defective print automatically.

Such a defective print detecting device comprises a CCD camera, photographing means such as a line sensor, a signal processing circuit to process an electrical signal as an output signal of the photographing means, and a rotary encoder for supplying a reference signal for processing to the signal processing circuit, and compares levels of corresponding positions of image data of the reference printed matter and image data of the printed matter to be checked to determine whether the difference between both levels is within a specified value and evaluate the quality of the print.

Since the above-described prior art defective print detecting device acquires image data for checking from a printed matter, it has the following disadvantages.

1) When checking the paper 3 which is being transported on the delivery chain 13 shown in FIG. 3, the paper 3 is gripped by the gripper devices 14 and transported, but since normally the paper 3 is gripped only at its leading edge and therefore the paper 3 is liable to flap during the transportation, another mechanism to prevent the flapping of the paper 3 must be provided, which increases the cost of the machine.

2) As shown in FIG. 3, when the intaglio cylinder 16 is provided with a plurality (three, for example) of intaglio printing plates 17 of the same patterns to make a plurality of prints by one turn of the intaglio cylinder 16, the mounting positions of the intaglio printing plates 17 relative to the intaglio cylinder 16 must be exactly adjusted so that the relative positions of the patterns on the intaglio printing plates 17 are constant, however, since this work is actually done manually, errors can occur. Therefore, this method cannot be applied in this case.

OBJECT AND SUMMARY OF THE INVENTION

With a view to obviate all of the prior defects of the defective print detecting device, it is a primary object of the present invention to provide a defective print detecting device, which can detect a defective print exactly and, even when printing with a plurality of printing plates of the same patterns mounted on the plate cylinder, can also detect exactly a defective print regardless of mounting errors of the printing plates.

In accordance with the present invention which attains the above object, there is provided a defective print detecting device for determining quality of prints printed by a printing apparatus, comprising photographing means for photographing the condition of the surface of a printing plate having a pattern to print mounted on a plate cylinder as an image, a position detecting sensor for detecting the rotational position of the plate cylinder, and a signal processing circuit for comparing reference image data of the surface of the printing plate acquired at the beginning of printing using the photographing means with checking image data of the surface of the printing plate acquired during printing using the photographing means according to a signal from the position detecting sensor and determining whether a difference in level between both image data is within a specified range; or comprising photographing means for photographing conditions of surfaces of a plurality of printing plates having individual patterns to print mounted on a plate cylinder as images, a position detecting sensor for detecting rotational position of the plate cylinder, and a signal processing circuit for comparing respective reference image data of the surfaces of the individual printing plates acquired at the beginning of printing using the photographing means with respective checking image data of the surface of the individual printing plates acquired during printing using the photographing means according to a signal from the position detecting sensor and determining whether differences in level between the image data are within specified ranges.

With the above described arrangement of the present invention, quality of prints can be determined from image data representing the condition of the surface of the printing plate.

When there are a plurality of printing plates, the above determination is made for each printing plate.

DESCRIPTION OF THE PREFERRED EMBODIMENT

Figure 3:
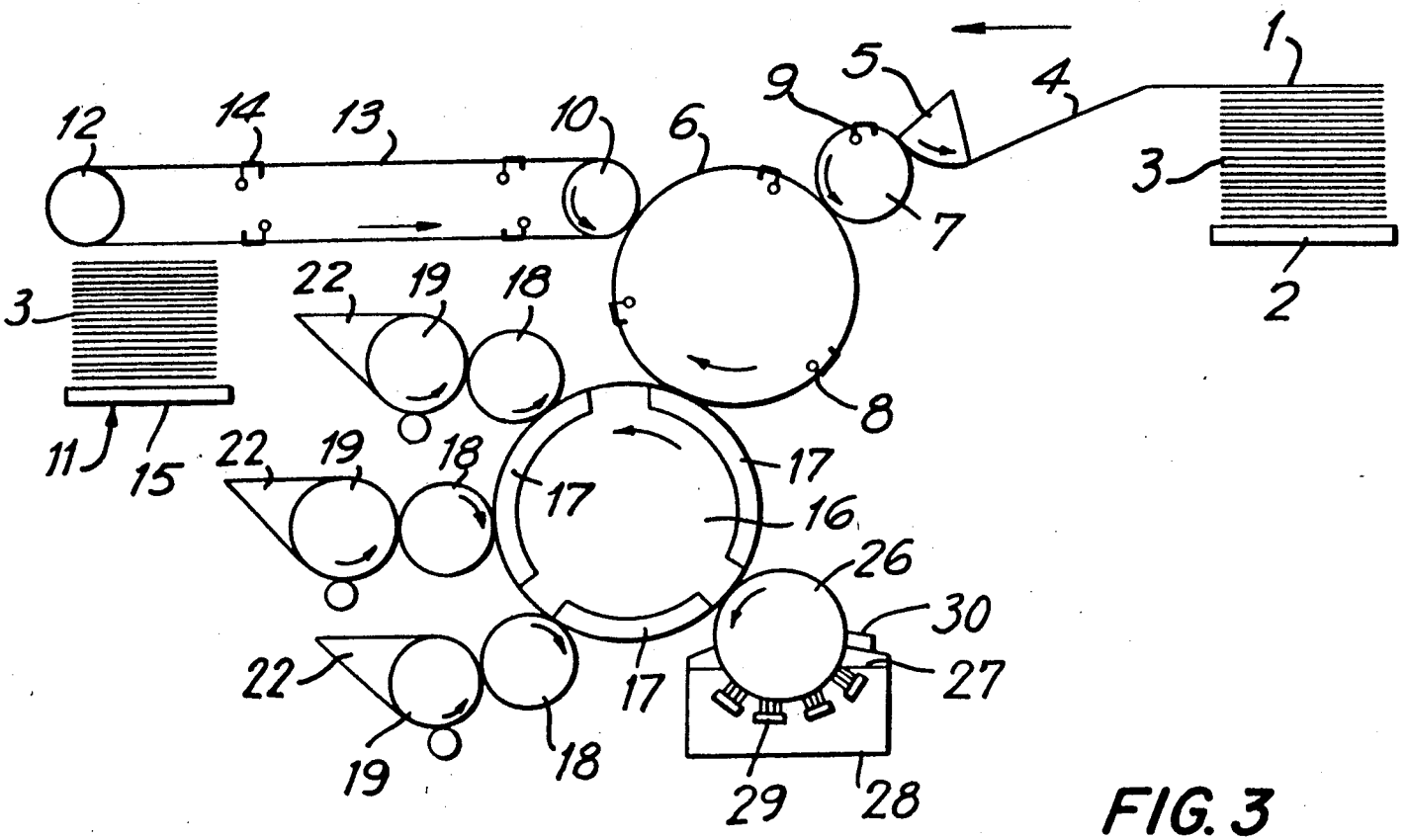
FIG. 3 PRIOR ART
FIG. 3 is a diagrammatic view showing schematically a prior art intaglio printing apparatus.

An embodiment of the present invention will now be described in detail with reference to the drawings. This embodiment is for a case when applied to an intaglio printing apparatus, which has three intaglio printing plates of the same pattern mounted on an intaglio cylinder. Therefore, the same parts as appearing in FIG. 3 are indicated with the same reference numbers, and the same description will be omitted.

Figure 1:
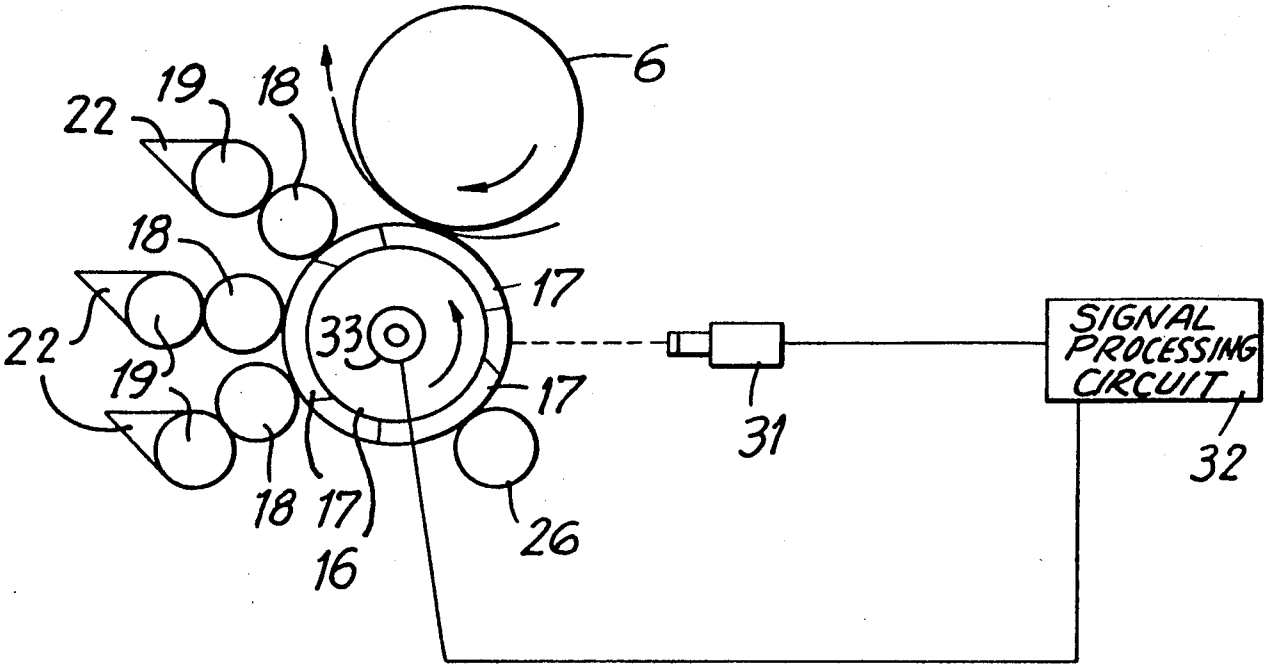
FIG. 1 is a diagrammatic view showing schematically the entire structure of an embodiment of the present invention.

Referring to FIG. 1, a CCD camera (hereinafter simply referred to as "camera") 31 as photographing means is disposed so that its lens faces the surface of an intaglio printing plate 17 at the downstream side of a wiping roller 26 with respect to the rotational direction of an intaglio cylinder 16 in order to photograph the surface after ink is wiped of by the wiping roller 26. A signal processing circuit 32 is to process an electrical signal as an output signal of the camera 31, which will be described in detail herein later. A rotary encoder as a position detecting sensor is connected to a rotary shaft of the intaglio cylinder 16 and supplies the camera 31 and the signal processing circuit 32 with rotational position information of the intaglio cylinder 16.

Figure 2:
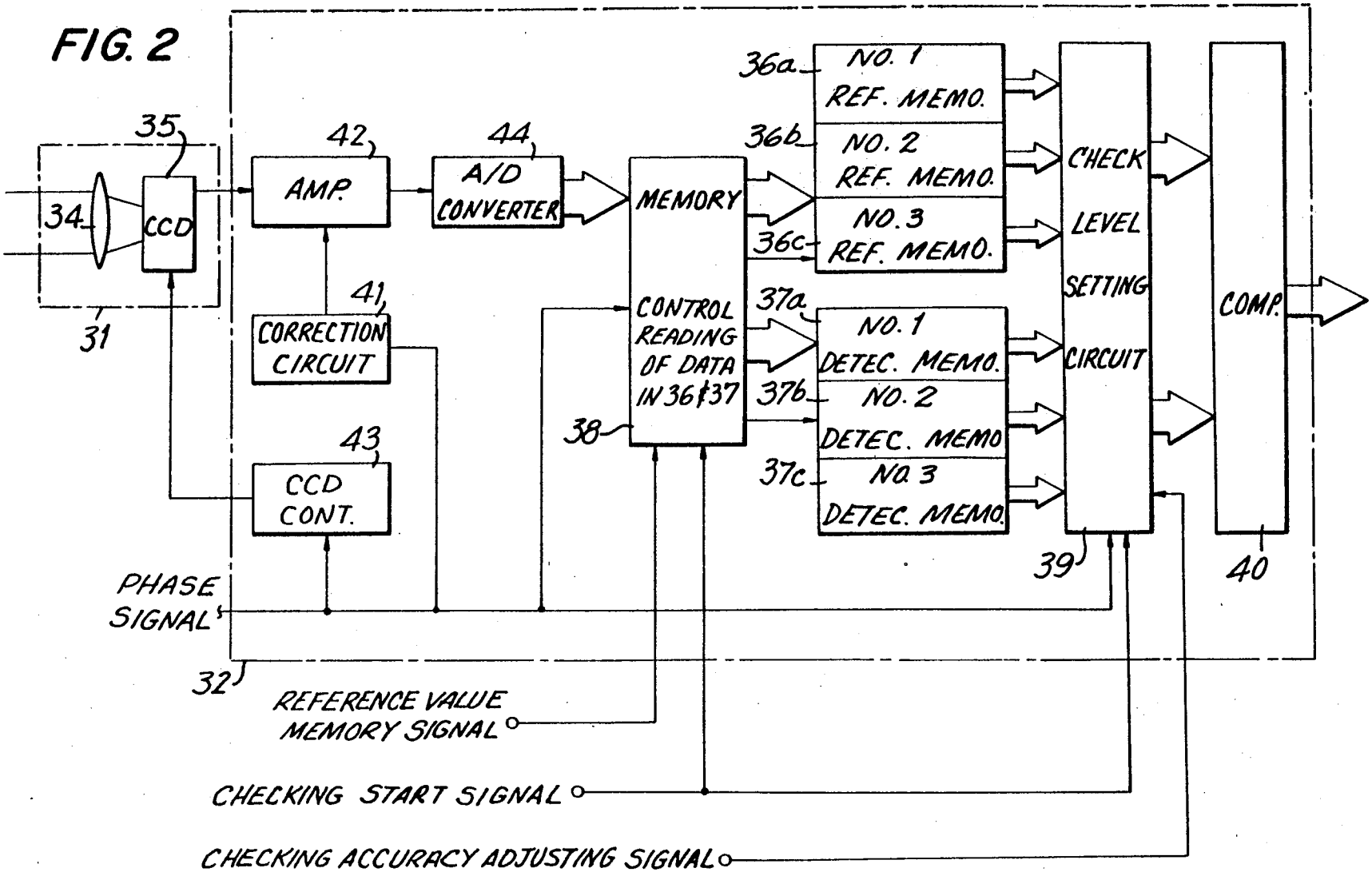
FIG. 2 is a detailed block diagram of the embodiment.

FIG. 2 is a block diagram of this embodiment. Referring to FIG. 2, the camera 31 comprises an optical system including a lens 34 and a CCD 35 which converts an image focused through the optical system to a corresponding electrical signal.

The signal processing circuit 32 is the part surrounded by two-dot-bar lines in FIG. 2. This embodiment has No. 1 to No. 3 reference memories **36*a*, 36*b*, and 36*c* corresponding to three intaglio printing plates 17 to store reference image data of the respective intaglio printing plates 17, and No. 1 to No. 3 detection memories 37*a*, 37*b*, and 37*c* to store checking image data for checking the respective intaglio printing plates 17. A memory controller 38 is to control reading data of the reference memories 36*a* through 36*c* and the detection memories 37*a* through 37*c*. A checking level setting circuit 39 sets an allowable level difference between the reference image data and the checking image data beforehand. A comparator 40 compares the reference image data with the checking image data and, when the level difference between both data exceeds the allowable level difference set by the checking level setting circuit 39, transmits a signal to represent the result. Thus, the reference image data and the checking image data corresponding to individual picture elements of the CCD 35 are compared one by one to compare levels of both data corresponding to the individual picture elements and, if there is even one which exceeds the allowable level difference, the comparator 40 outputs a signal. A correction circuit 41 adjusts the gain of an amplifier 42 according to the rotation speed of the intaglio cylinder 16. Since even when the camera 31 is applied with light of the same intensity, the output signal level of the CCD 35 decreases with inceasing rotational speed of the intaglio cylinder 16, the correction circuit 41 compensates for the effect of the rotational speed. In FIG. 2, numeral 43 indicates a CCD controller, and numeral 44** indicates an A/D converter.

The signal processing circuit 32 comprising these blocks is controlled by the following signals. A phase signal, an output signal of the rotary encoder 33, consists of a reference signal which rises at every turn of the intaglio cylinder 16 (at the starting position of a first intaglio printing plate 17, that is, a reference position) and a clock pulse which is a pulse signal for data read/write rising at every specified turn of the intaglio cylinder 16, and is supplied to the memory controller 38, the checking level setting circuit 39, the correction circuit 41, and the CCD controller 43. A reference value memory signal is a signal to cause the reference memories **36*a* to 36*c* to read the reference image data through the memory controller 38, which is supplied by turning on a switch (not shown). A checking start signal is a signal to start comparison of the reference image data with the checking image data, and is supplied by turning on a switch (not shown). A checking accuracy adjusting signal is a signal to adjust a preset value of the checking level setting circuit 39, that is, the value of allowable level difference. A step signal is an address signal for the reference memories 36*a* through 36*c* and the detection memories 37*a* through 37*c***.

With the embodiment of the present invention described above, first the operator checks visually the condition of printed matter actually printed while performing test printing to determine the quality and, if it is satisfactory, causes the reference value memory signal to be transmitted. After than, when the reference signal representing the reference position is transmitted from the rotary encoder 33, the reference image data from the first intaglio printing plate 17 is written into the first reference memory 36*a*. The writing is continued until the intaglio cylinder 16 is detected, by the clock pulse of the rotary encoder 33, to be at a position corresponding to a notch. When the starting position of the second intaglio printing plate 17 is detected, writing of the reference image data is re-started to store the reference image data into the second reference memory 36*b*. Using the same procedure, the image data of the third intaglio printing plate 17 is stored into the third reference memory 36*c*. After the reference image data of the surfaces of the individual intaglio printing plates 17 are stored in the first to third reference memories 36*a* to 36*c*, a specified checking process is started by the checking start signal. This process is the same as writing the reference image data, in which, as the intaglio cylinder 16 rotates, the checking image data of the surfaces of respective intaglio printing plates 17 are written into the corresponding first to third detection memories 37*a* to 37*c*, and these checking image data are compared with the corresponding reference image data to determine whether the level differences between both image data are within the allowable level difference. Thus, a defective print can be detected, if any.

Since, in the intaglio printing operation, after the intaglio printing plates 17 are supplied with ink, excessive ink is wiped off by the wiping roller 26, ink is applied only onto the recessed areas on the surfaces of the intaglio printing plates 17 at the downstream side of the wiping roller 26, and then the ink is transferred to the paper 3. On the other hand, most staining occuring during printing is attributed to the fact that excessive ink on the projecting areas of the surfaces of the intaglio printing plate 17 cannot be completely wiped off. Therefore, the condition of the surfaces of the intaglio printing plates 17 after excessive ink is wiped off may be considered to be the same as the quality of the printed matter.

As described above in detail with reference to this embodiment, the present invention, in which the quality of printed matter is determined by observing the condition of the surface of the printing plate, can provide exact determination of the quality of printing without being affected by conditions of the printed matters at the time of checking such as flapping during transportation, as compared with a case where the quality is determined from printed matters. Further, the present invention can also be applied to a case where a plurality of printing plates are mounted on a single plate cylinder, in which reference image data is compared with checking image data for each printing plate, and therefore the quality of all printed matters can be exactly identified without being affected by mounting conditions of the printing plates on the plate cylinder.

I claim:

1. A defective print detecting device for determining the quality of prints which are printed by an intaglio printing apparatus comprising, an intaglio plate cylinder having a peripheral surface upon which is mounted a first intaglio printing plate, ink applying means in rolling contact with said peripheral surface of said plate cylinder, wiping means in rolling contact with said peripheral surface of said plate cylinder at a point downstream of said ink applying means for removing excess ink and for forming an ink pattern deposited on the surface of said first printing plate, and impression means in rolling contact with said peripheral surface of said plate cylinder at a point downstream of said wiping means for impressing said ink pattern on a sheet of paper, said defective print detecting device comprising:

photographing means directed at said peripheral surface of said plate cylinder at a point downstream of said wiping means and upstream of said impression means for photographing the ink pattern deposited on the surface of the said first printing plate to determine the condition of said pattern after wiping and before impressing;

signal processing means, coupled to said photographing means, for comparing reference image data of the ink pattern deposited on the surface of said first printing plate during a first printing operation with checking image data of the ink pattern deposited on the surface of said first printing plate during a second printing operation performed subsequent to said first printing operation, said signal processing means including means for determining whether the difference between the reference and checking image data is within a specified range, and position detecting means, coupled to said plate cylinder, for detecting the rotational position of said plate cylinder and outputting a signal corresponding to said detected rotational position to said signal processing means.

2. A defective print detecting device as recited in claim 1, further comprising second and third printing plates mounted on said plate cylinder.

* * * * *